US005695089A

United States Patent [19]

Reese et al.

[11] Patent Number: 5,695,089

[45] Date of Patent: Dec. 9, 1997

[54] LIGHTWEIGHT DOUBLE WALL STORAGE TANK

[75] Inventors: R. Allan Reese, Seattle, Wash.; Lorri J. Grainawi, Palatine, Ill.

[73] Assignee: Steel Tank Institute, Lake Zurich, Ill.

[21] Appl. No.: 379,724

[22] Filed: Jan. 27, 1995

[51] Int. Cl.[6] ..... B65D 90/04

[52] U.S. Cl. ..... 220/428; 220/445; 220/454

[58] Field of Search ..... 220/454, 455, 220/457, 445, 469, 428

[56] References Cited

U.S. PATENT DOCUMENTS

| | | | |
|---|---|---|---|
| 4,374,478 | 2/1983 | Secord | 220/445 |
| 4,739,659 | 4/1988 | Sharp | 220/445 |
| 4,826,644 | 5/1989 | Lindquist et al. . | |
| 4,931,235 | 6/1990 | Lindquist et al. . | |
| 4,934,122 | 6/1990 | Lindquist . | |
| 4,963,082 | 10/1990 | Lindquist et al. . | |
| 4,989,447 | 2/1991 | Gelin | 220/445 |
| 5,000,342 | 3/1991 | Sharp | 220/454 |
| 5,012,949 | 5/1991 | McGarvey et al. . | |
| 5,038,456 | 8/1991 | McGarvey . | |
| 5,081,761 | 1/1992 | Rinehart et al. . | |
| 5,082,138 | 1/1992 | McGarvey . | |
| 5,092,024 | 3/1992 | McGarvey . | |
| 5,103,996 | 4/1992 | McGarvey . | |
| 5,157,888 | 10/1992 | Lindquist . | |
| 5,251,473 | 10/1993 | Reese | 220/445 |
| 5,271,493 | 12/1993 | Hall . | |
| 5,282,546 | 2/1994 | Bauer | 220/445 |
| 5,285,914 | 2/1994 | Del Zotto | 220/445 |
| 5,368,670 | 11/1994 | Kauffman | 220/445 |
| 5,494,183 | 2/1996 | Sharp | 220/445 |

*Primary Examiner*—Joseph M. Moy
*Attorney, Agent, or Firm*—Harris Beach & Wilcox, LLP

[57] ABSTRACT

A tank assembly which includes an inner storage tank and a surrounding outer containment tank with said tanks defining a substantially uniform space therebetween. The space is filled with a cured light weight porous monolithic insulating material having a porosity sufficient to allow liquid and vapors to migrate through said insulating material to a monitoring point, or points contained within said space. Means are provided for monitoring liquid and vapors located at said monitoring point or points, with the insulating material freely permitting vapors to migrate to an emergency vent port without over pressurization build-up within said space.

15 Claims, 4 Drawing Sheets

24
54
70
58
52
74
32
72
76
64
56
60
26
34
28
40
30
62
6

LIGHTWEIGHT DOUBLE WALL STORAGE TANK

FIELD OF THE INVENTION

The present invention relates to an aboveground storage tank for various liquids, such as combustible, flammable liquids like motor fuel, and to methods for fabricating such tanks.

BACKGROUND OF THE INVENTION

For many years, underground storage tanks have been widely used in many industries to store chemicals and flammable or combustible liquids. One common use has been storage tanks for dispensing motor fuel and other petroleum products directly into motor vehicles. The earth surrounding such underground storage tanks has been viewed as providing a natural protective barrier for the tank, providing protection against interference from the surface environment and from natural and man-made occurrences and activities.

Substantial technology for fabricating underground storage tanks has been developed over the years. As one example, U.S. Pat. No. 4,640,439 to Palazzo concerns a double wall storage tank for liquids that has been commercially utilized.

More recently, environmental concerns due to the possibility of leaking fuel seeping into the soil or aquifers has resulted in altered requirements for such underground storage tanks by the Environmental Protection Agency (EPA). EPA's underground storage tank program that has evolved since then, provides generally accepted benchmarks for the safe, reliable underground storage of petroleum and hazardous liquid products. Since this federal program began, remediation costs have skyrocketed as a result of the need to clean up leaking tank and pipe sites, backfill and surrounding soil or groundwater.

Partly as a result, market demand has shifted toward the use of aboveground storage tanks. An increasing trend toward the use of factory-fabricated aboveground storage tanks has thus resulted in the past few years. However, using aboveground storage tanks for dispensing liquid petroleum products required that the tank design satisfy the applicable fire codes. These fire codes were relatively restrictive as regards the use of such aboveground storage tanks for dispensing motor fuel and the like directly into motor vehicles. Further, all tanks storing flammable or combustible liquids, including tanks used for non-fueling purposes, required spill control. A dike structure surrounding tanks is one approach which satisfies the spill control requirement of various codes.

In general, aboveground tanks for fuel dispensing systems were permitted in areas to which the public did not have access when installed in a special enclosure constructed in accordance with particular requirements. One modification that was eventually adopted was to define "special enclosure" to include six inches of concrete enclosing a fuel-dispensing aboveground storage tank. U.S. Pat. No. 4,826,644 to Lindquist et al. is one example of an aboveground steel storage tank entombed in a concrete vault structure.

Even the various specifications and tests that had to be met by fuel-dispensing aboveground storage tanks were influenced by this concrete vault structure. Indeed, even currently, and although it is not particularly germane to a tank structure having an outer wall constructed of steel, one such test which is still required for aboveground fuel-dispensing tanks involves spraying water on the storage tank to determine, under certain conditions, whether the insulation (e.g., concrete) remains intact to spalls, as might occur with a concrete outer wall.

Such concrete vault structures suffered from various drawbacks. Thus, one drawback was weight. The relatively heavy concrete vault structure limited the size of the storage tank if the desire was to fabricate the structure at one location and then ship to another location to be placed in service. Such heavier structures thus required more complicated transportation techniques and were also relatively costly.

Quite recently, some fire codes have allowed aboveground storage tanks for fuel dispensing systems that are protected by a tested and approved tank enclosure assembly providing fire resistance protection of not less than 2 hours from exposure to a flammable liquid pool fire, provided that specific approval was obtained. An approved listing was that of Underwriters Laboratory Inc. (UL) or other equivalent third party testing laboratories.

UL subject 2085, extensively sets forth the specifications, requirements, dimensions, as well as the performance, manufacturing and production tests that are necessary for fire protected aboveground tanks for fuel dispensing systems. The insulated tanks circumscribed are double wall storage tanks comprising a primary containment tank for the fuel and a secondary containment tank for containing the primary containment tank. Primary containment tanks are defined by their actual capacity with, for example, the primary containment horizontal cylindrical tanks having maximum diameters as well as minimum steel thickness, depending upon whether the steel is carbon or stainless steel. The minimum steel thickness specification, of course, increases with the increasing actual capacity of the primary containment tank.

UL 2085 requires that the insulation system encase the primary containment tank, except that fittings and tank connections may protrude through the insulation system. In addition, the insulation system cannot interfere with the intended operation of the required means provided for emergency relief venting of the interstitial space between the primary and the secondary containment tank. Additionally, during a hydrocarbon pool fire test, the temperatures recorded on the primary tank and structural support any time during or after the two hour fire exposure cannot exceed a particular average maximum temperature rise (two criteria being set forth).

Additional requirements dictate overfill prevention equipment, dispensers, spill control, and the like. Thus, the type, and even the positioning of valves and tank openings, are largely dictated by the respective standards.

Because both industry and code authorities requested UL to develop a program to test a tank with insulation surrounding it, the UL 2085 subject utilizes the UL 142 tank as the basis for the primary containment tank. The secondary containment tank, which must also satisfy UL 142, was included to address concerns of primary containment tank leakage so as to prevent escape of the fuel or the like into a navigable stream or the creation of a petroleum spill pollution incident, or create or fuel a nearby fire.

The double wall tanks thus provided in UL 2085 have the ability to use conventional double wall tank structures as have been used for a wide variety of liquids, chemicals and the like. Insulated structures such as cryogenic tanks and insulated heavy oil tanks while somewhat different structurally have also been available for many years.

Among the several patents which have resulted as companies followed the evolving fire codes is U.S. Pat. No. 5,081,761 to Rinehart et al. which illustrates a lightweight, double wall tank. Two conventional cylindrical steel tanks spaced from one another are provided with a cementitious, curable insulating material, such as the commercially available Pyrocrete™ insulating material positioned in the interstitial space between the two tanks. The Pyrocrete™ material identified in the '761 patent has been commercially available for use in the fire protection of, among other applications, structural steel and LPG vessels since at least 1980's.

As described in the '761 patent, when used as a fireproofing material between the two sealed tanks, rather than as an external coat exposed to the atmosphere, cured Pyrocrete™ retains a fixed amount of additional moisture. The slow evaporation of the additional moisture during an external fire condition is said to prolong the fireproofing function of the resultant tank structure to at least two-plus hours.

Additionally, the Rinehart et al. patent applies the cementitious insulating material, mixed with water, in a conventional concrete or mortar mixture. The insulating material, in a viscous, plastic state, is pumped by a conventional mortar pump through a hose upwardly into all of the space between the interior and exterior tanks. Pumping the insulation material upwardly and filling the space between the bottom is said to eliminate air pockets and enable the dissemination of the material into all of the spaces between the tanks. With the double wall tank having any of a wide variety of insulating materials being positioned in the space being known in this field, the '761 patent concerns a method of fabricating a double wall storage tank of that type.

However, there still exists the need for a method of fabricating a double wall storage tank in a manner more amenable to commercial use than is described in the '761 Rinehart et al. patent, as well as such a tank so fabricated that satisfies the UL 2085 requirement.

SUMMARY OF THE INVENTION

The above objectives and the short comings of the prior art are addressed in accordance with the present invention which provides for a novel double wall storage tank and method of fabrication.

The present invention is directed to a lightweight double-wall storage tank which contains a lightweight insulation material within the interstice or space between the primary and secondary tanks. The insulation material is porous which allows a liquid leak from the storage tank to flow or migrate through the interstice to a monitoring point. More specifically, the double-wall tank comprises an assembly which includes an inner primary storage tank and a surrounding outer containment tank with the storage and containment tanks defining a substantially uniform space therebetween. The space between the tanks is filled with a cured lightweight porous monolithic material which comprises perlite, cement and water, and in the original slurry prior to curing, includes an air entrainment agent which provides for added porosity to the cured insulation material. The porosity of the cured monolithic structure is sufficient to allow liquid and vapors to flow through the structure, and in the case of a liquid leak, to allow its presence to be detected at a predetermined monitoring point or points within approximately 24 hours following the leakage of the liquid from the storage tank.

A further advantage of the present invention is that the porous monolithic insulating structure which comprises cured cement and perlite, also contains both excess water and bound hydrated water which provides for added protection to the storage tank during an external fire. When subjected to an external fire, the external steel tank surface temperature rises relatively quickly to 2000° F., probably within the first half hour. At this point, a number of things happen. The first is that, due to the relatively high thermal conductivity of the insulation, the insulation material, and the interior tank, are heated to 212° F., the boiling point of water. The temperature in the insulation does not exceed 212° F. because this temperature cannot be exceeded until the free water has been boiled away.

As the water boils from the insulation material, a thermal front is formed and all of the water boils at the surface of this front. Toward the inside of the tank from this front, the temperature is 212° F. and there is no boiling. Toward the outside of the insulation, relative to the front, the temperature is greater than 212° F. and all of the free water has been driven off. The rate of boiling drops off very quickly as this front moves from the outer surface to the inner surface of the insulation material. This is because insulation material which has its water removed is a good thermal insulator, much better than the insulation with its water. This effect tends to keep the temperature of the inner storage tank at a low level, and otherwise extends the fire insulating function of the assembly with respect to the storage tank.

In addition to the above, the porosity of the insulating material is such that in the event that the insulating material is saturated with motor fuel and then the tank is subjected to a hydrocarbon pool fire, the insulating material is porous enough to allow the motor fuel to evaporate and burn off safely without the tank exploding or otherwise harming people, property or the environment.

Also, as light weight and porous as the insulating material is, used in this unique way the resultant insulated tank is strong enough to stand up to a UL Vehicle Impact Test.

In addition to the above, the tank structure of the present invention, does not require any internal support structure between the walls of the tank. In the event of an external fire, this structure provides for greater insulation for the internal storage tank in that there are minimal connecting metal contacts from the outside containment tank to the inside storage tank which would contribute to increasing the temperature of the storage tank during a fire.

Another advantage of the insulating material of the present invention relates to corrosion. It is essential that the insulating material not create a leak through corrosion of the steel. Since perlite is a form of natural glass, it is considered chemically inert and has a pH of about 7. These properties of perlite does not contribute to any corrosion problem which could be associated with other insulating material of the prior art.

The present invention provides a lightweight double wall tank of simple construction which satisfies both the UL 2085 and UL 142 requirements with respect to the 2-hour fire and secondary containment standards.

DETAILED DESCRIPTION OF THE INVENTION

Figure 1:
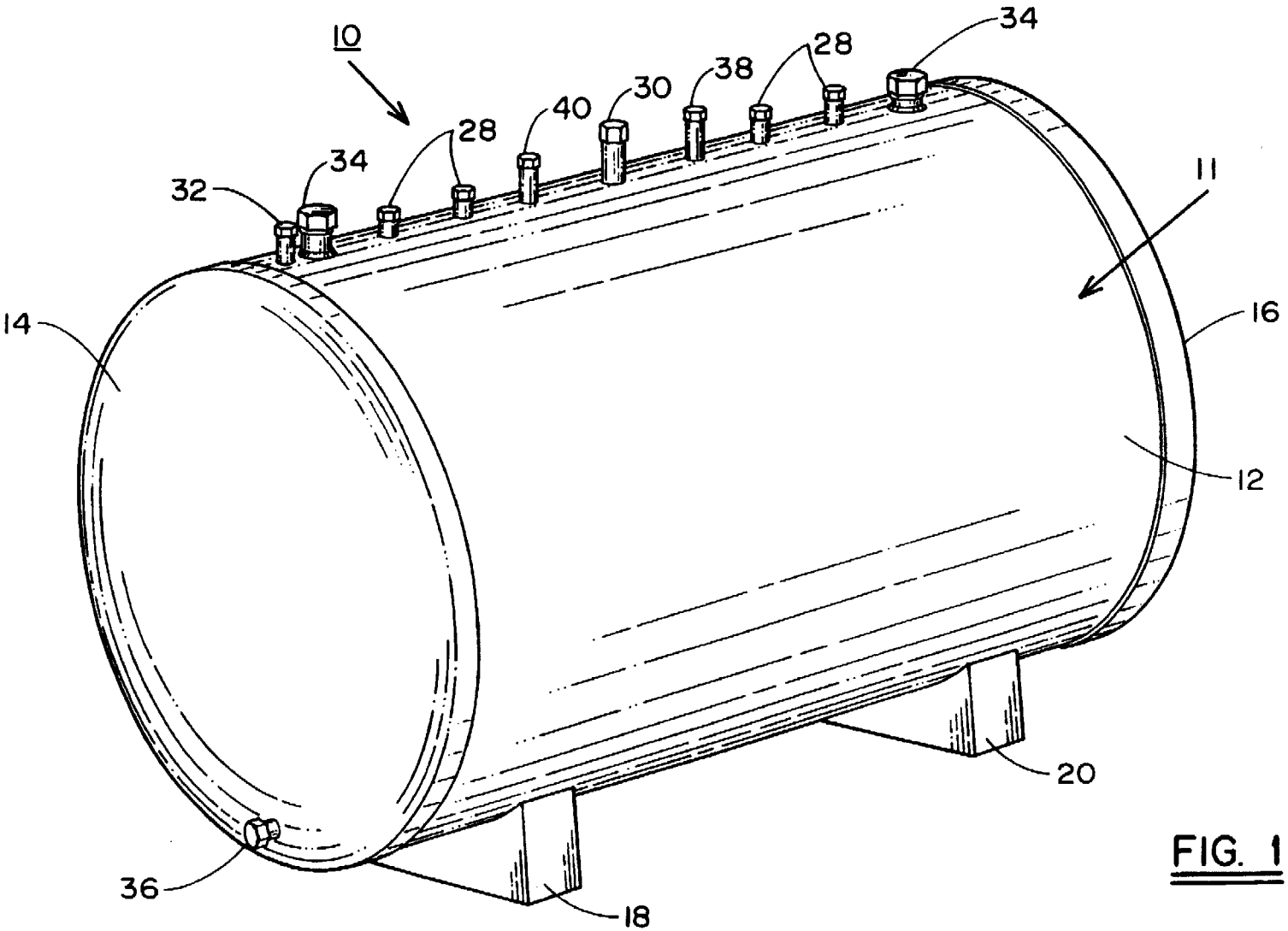
FIG. 1 is a perspective view of a horizontal cylindrical tank according to the present invention.

Referring to the drawings, FIG. 1 illustrates a perspective view of a cylindrical double wall tank 10 illustrating one embodiment of the present invention. The double wall tank 10 is disposed horizontally and comprises an outer containment tank 11 having a continuous, outer side wall or shell 12 and two end walls or heads 14 and 16, respectively. The double wall tank is typically supported on a pair of supports or saddles 18 and 20, respectively.

Figure 3A:
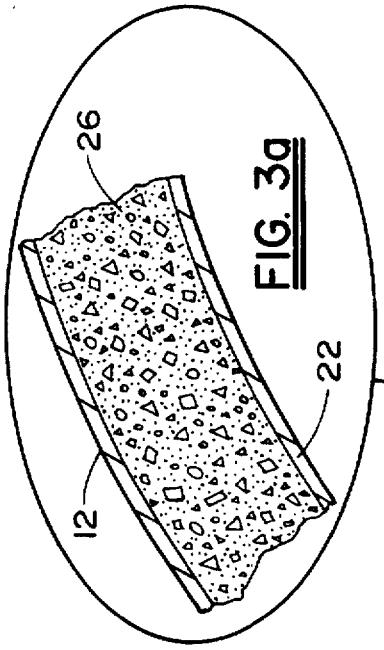
FIG. 3A is a partial enlarged sectional view of the tank side wall of FIG. 3.
Figure 3:
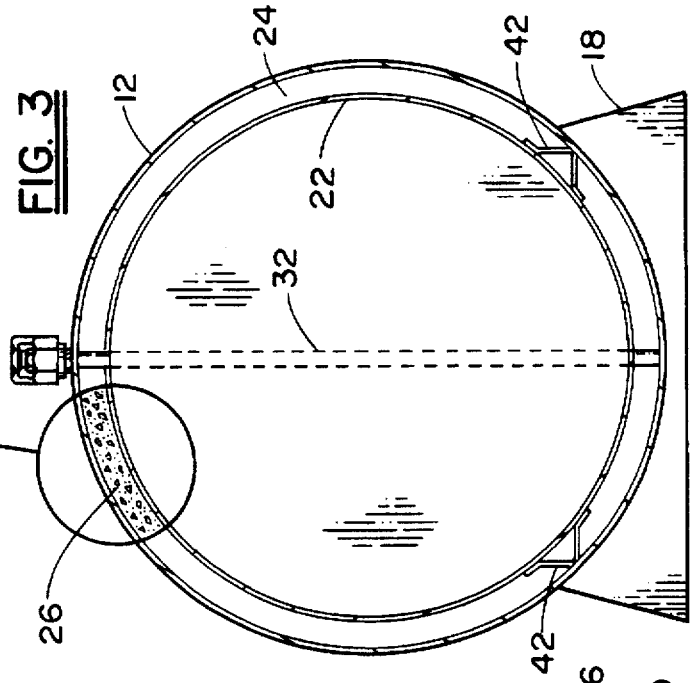
FIG. 3 is an end sectional view of the tank illustrated in FIG. 1.
Figure 2:
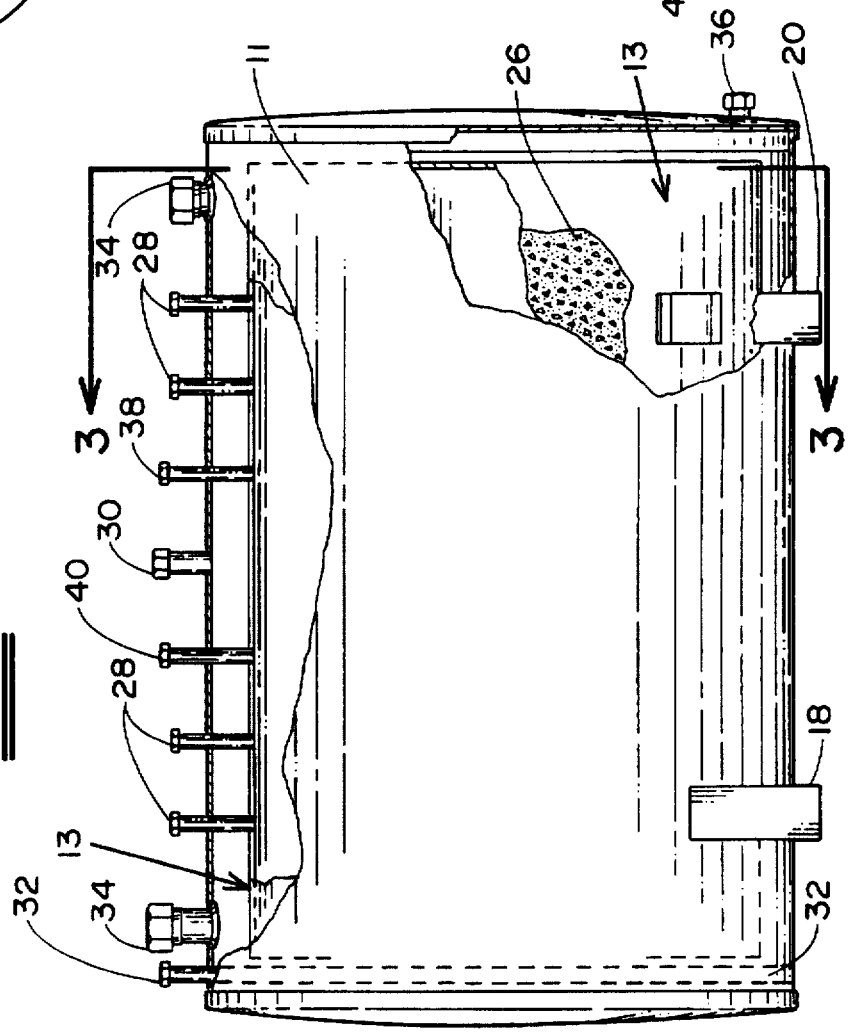
FIG. 2 is a side sectional view of the tank illustrated in FIG. 1.

FIGS. 2 and 3 illustrate cross-sectional side and end views, respectively, and illustrate the double wall construction of the present invention in which the wall 12 of containment tank 11 and the side wall or shell 22 of inner storage tank 13 forms a gap or interstitial space 24 which is filled with the monolithic porous insulating material 26 of the present invention, which is more specifically defined hereinafter (see also FIG. 3A). The thickness of the gap or interstice between the walls of the tank can range from about 2½ to 6 inches. The double wall tank 10 is provided with conventional fittings, vents, and monitoring hardware illustrated by reference characters 28, 30, 32, 34, 36, 38 and 40. More specifically, the tank contains four-pipe fittings common to motor fuel storage tank systems 28. One of the fittings functions as an inlet to pour liquid into the tank and another to pump fuel from the tank for dispensing fuels to vehicles. The third fitting is typically used to monitor the liquid level in the tank and the fourth fitting is typically used for vapor recovery. The tank further contains secondary tank and primary tank emergency vents 30 and 38, respectively and a monitoring pipe 32 which is described in more detail hereinafter which functions to monitor leaks from the inner storage tank 13. The tank also may contain two upper fittings 34 and may contain a lower fitting 36 which are used to install the insulation material 26 and also contains a normal conventional vent 40.

Figure 4:
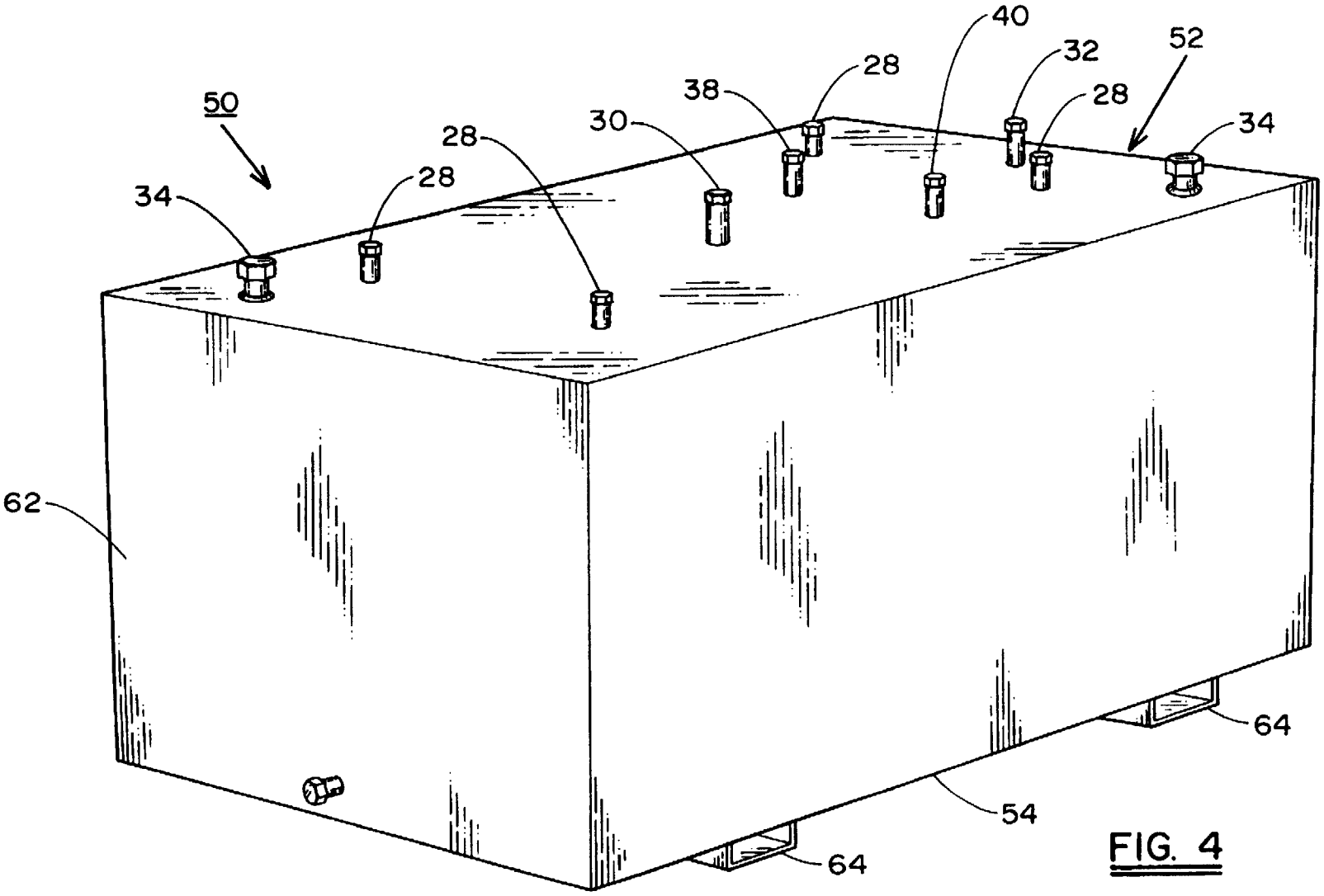
FIG. 4 is a perspective view of a rectangular tank design of the present invention.

FIG. 4 illustrates a perspective view of a double wall rectangular tank 50 illustrating a second embodiment of the present invention. The double wall tank comprises an outer containment tank 52 (see FIGS. 5 and 6) having side walls 54 and 56, a top 58 and bottom 60, and two end walls 60 and 62, respectively The tank is supported on a pair of supports 64.

Figures 5, 6, 6A:
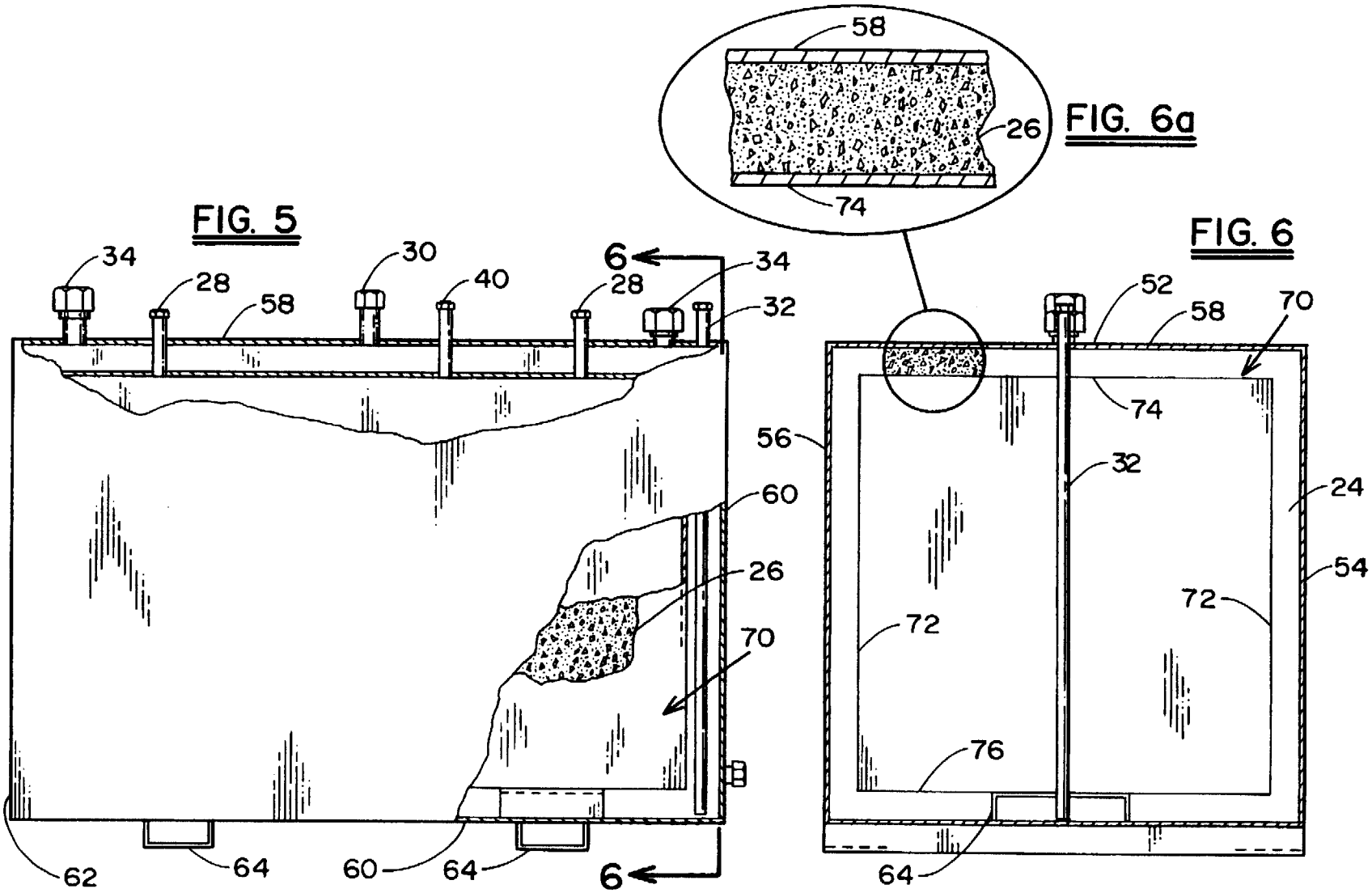
FIG. 5 is a side sectional view of the tank illustrated in FIG. 4.
FIG. 6 is an end sectional view of the tank illustrated in FIG. 4.
FIG. 6A is a partial enlarged sectional view of the tank side wall of FIG. 6.

FIGS. 5 and 6 illustrate cross-sectional side and end view, respectively, and illustrate the double wall construction of the tank. The walls of the containment tank 52 and the walls of inner storage tank 70 form a gap or interstitial space 24 which is filled with the monolithic porous insulating material 26 of the present invention (see also FIG. 6*a*). The tank is provided with the same conventional fittings, vents and monitoring hardware illustrated by reference characters, 28, 30, 32, 34, 36, 38 and 40 for cylindrical tank 10.

The walls of the double wall tank are typically made of carbon steel as specified in UL 142 which is welded together by conventional techniques well known to the art. The wall thickness for these tanks range from about 0.093 to 0.375 inches depending upon tank capacity which can range from about 175 to 50,000 gallons for a cylindrical tank. All of the tank components are also welded together by conventional techniques well known to the art. For certain applications, the tank may be made of other metals or alloys such as, for example, stainless steel. In fabricating the double wall cylindrical tank, storage tank 13 may be positioned concentrically within the outer containment tank 11 on two pair of metal spacers 42 (spacer 66 for the rectangular tank) positioned near each end of the tank as shown in FIG. 3. The purpose of the spacers is to accurately position inner tank 13 within outer tank 11 in order to provide a uniform gap or interstitial space 24 between the two tanks. In forming the double wall cylindrical tank, the outer containment tank would have at least one open end, with for example, head or end wall 14 & 16 unattached. In one embodiment, the four metal spacers 42 are welded to the inner tank and the inner tank typically lifted with a crane and move horizontally for placement within the outer tank. The four spacers 42 ensure that a uniform concentric space 24 is maintained between the two tank walls. The spacers are configured to transfer only a minimum amount of heat from the outer tank to the storage tank in the event of an external fire. Following placement of the inner tank, end wall or head 14 or 16 is then welded in place. The various fittings, vents, and monitoring equipment, elements 28, 30, 32, 34, 36, 38, and 40 are then fixed in place by techniques well known to the art.

The material which fills space 24 is an insulating material which comprises perlite, cement, an air entrainment agent and water. Optionally, a small amount of plasticizer may also be used to control the viscosity of the mixture. The ingredients are mixed together with water in the appropriate proportions and poured or pumped into the space between the tanks, until the insulation is no more than approximately one inch from the top of the outer tank. The insulation may be applied from the top of the tank or through the bottom of the tank through ports 34 or 36. This aqueous mixture is allowed to cure, and sets to a compressive strength within the range of about 25 psi to 150 psi, depending upon the formulation and materials used. A compressive strength in this range has been found to be sufficient to support the tank structure without any internal support structure.

The porosity of the cured insulation material must be sufficient to allow liquid or vapor to pass through it. Typically porosity should be in the range of about 40 to 80% by volume. This porosity range which provides for the necessary compressive strength of the cured insulation material. Perlite suitable for use in the present invention should typically have a density of about 4 $lb/ft^3$ to −10 $lb/ft^3$ and a sieve size of about 15%+8 to 50%+100. Perlite meeting these requirements can be purchased to specification from Strong-Lite Corp., of Pine Bluff, Ark. or Silbrico Corp. Hodgkins Ill.

Perlite is a naturally occurring silicious rock or volcanic glass. The distinguishing feature which sets perlite apart from other similar minerals and volcanic glasses is that when heated to a suitable point in its softening range, it expands from four to twenty times its original volume. This expansion is due to the presence of two to six percent combined water in the crude perlite rock. When quickly heated to above 1600° F. (871° C.), the perlite rock pops in a manner similar to popcorn as the combined water vaporizes and creates countless tiny bubbles or voids which account for the light weight and other exceptional physical properties of expanded perlite, which is the type used in the present invention.

Perlite is a form of natural glass. It is classified as chemically inert and has a pH of approximately 7.

The cement used in the aqueous mixture is conventional Portland cement.

The use of an air entrainment agent is an essential component in the formulation of the insulation material of the present invention in that it produces air bubbles in the aqueous mixture which reduces the density by increasing the void space in the cured insulating material. Suitable air entrainment agents include vinsol resins, available from Master Builders, of Cleveland, Ohio and from W.R. Grace Chemical Co. of Cambridge Mass. under the tradename Daravair-R.

The porosity of the insulation material of the present invention is essential for two reasons. First, it is necessary to monitor the interstitial space, or gap, between the two walls of the double wall tank, for leaks from the primary storage tank. Fluid leaking from the primary tank flows through the porous insulation forming a pool at the bottom of the secondary tank. In one embodiment, the monitoring is done by providing the tank with a monitoring pipe located between the two walls of the tank. In this embodiment, the pipe is placed through the insulation material. The pipe, typically is 1½ inches in diameter and is placed through the top of the secondary or containment tank, next to the head of the tank, all the way down to the bottom of the secondary tank. The bottom of the pipe or its cover is slotted or perforated to allow the liquid to run into the pipe. Leaks are detected by either placing a dip-stick into the monitoring pipe to detect the liquid, or by the use of any conventional leak detection device sold on the market.

Porosity is also necessary to allow vapors to be released from the secondary containment tank in the event of a fire. These vapors are generated in the interstice and may be from either the product stored in the inner storage tank if there had been a undetected leak into the secondary containment area before the fire, or it may be water vapor being released from the insulation material itself. The vapors travel through the insulation material out through an emergency vent located near the top center of the tank.

In addition to the size and density of the perlite, other factors which influence the porosity of the cured insulation material include the ratio of water to cement, and ratio of perlite to cement which preferably is about 8:1 by volume. Other factors which effect porosity include how much the material has been allowed to dry, the quantity of air entrainment agents used, and if other additives are used such as plasticizers.

In filling the interstice of the tank the aqueous mixture is poured or pumped into the interstice between the tank walls and is allowed to cure and harden into a porous material capable of insulating the inner tank to meet the requirements of UL 2085 or other third party testing lab. The cured insulating material hardens into a porous monolithic structure. Water is added in sufficient quantities to enable the material to be poured.

The quantity of water and air entrainment agent need to be carefully controlled to maintain the correct combination of compressive strength and porosity. Generally, the lighter the end product, the lower the compressive strength. The more air in the mix, the lighter the end product. The quantity of air entrained is dependent on the quantity of air entrainment additive used, length of mix time, and the size and density of perlite used.

A ratio of ¼ pint of air entrainment agent to every 2 gallons of water has been found to be satisfactory.

The following material specifications illustrate one embodiment of a formulation suitable for use in making insulation layers of the present invention.

Material Specifications

Perlite grade size: Minimum 50% † 100 Mesh; Maximum 15% † 8 Mesh.

Perlite density: 4–10 lbs per cubic foot

Cement: Portland Cement

Air Entrainment Agent: vinsol resin

Formula 1.75–2.25 gallons water 1 cubic foot perlite 11.8 lbs cement

¼ pint Air Entrainment Agent

Wet density of the above mix should range from 28–40 lbs. per cubic foot

A suitable ratio of perlite to cement to water to air entrainment agent by volume=8:1:2:0.03

The following example illustrates a suitable procedure for formulating, pouring, and curing the insulating material of the present invention.

EXAMPLE

Add air entrainment agent to water in mixer. Mix until frothy. Add cement and mix for 1–2 minutes, or until well blended. Add perlite and mix for a minimum amount of time. Check the wet density of the mix. Continue mixing, if necessary, to achieve the desired wet density of the mix. If mixture is to be pumped, place hose to the bottom of the tank through an opening port on the top of the tank, or, connect hose to a fitting at the bottom of the tank. Pump mixture into the interstice and measure the wet density periodically. Continue batches until the insulation is no more than approximately one inch from the top of the outer tank. Allow mixture to cure and harden for 24 hours at above 70° F. At temperatures between 40°–70° F. the curing should be a minimum of 48 hours.

The double wall steel tank of the present invention provides the following advantages over tanks currently being used in the field.

1. The outer steel shell of the containment tank provides a physical and environmental protection to the porous insulation.

2. The outer wall has as its primary purpose to provide secondary containment so that in the event of a leak in the primary tank, product is confined by the outer wall. It also serves as the insulation form, providing an easy method of forming the porous monolithic insulation layer.

3. The outer wall provides physical protection for the insulating against collisions. Collisions with the tank can occur during a fire if a structural beam or other object falls on the tank or by vehicular impact. If the steel were not present, the monolithic insulation could be broken, causing it to fall away from the tank which would result in total or partial loss of insulation around portions of the primary tank. Because of the presence of the steel wall, even if the insulation is fractured, the outer steel wall keeps the insulation in place.

4. Because of the outer steel wall, it is not necessary for the insulation to have a high compressive strength. The steel shell contains the insulation and prevents it from moving in the event the monolith is fractured.

5. The inner tank is kept cool because of the actions of the monolithic insulation acting as an insulator, by heat being absorbed by vaporizing both bound and excess water contained in the insulation, and by heat being absorbed in heating steam and product vapor from their boiling points to their temperature when they leave the tank system. It is believed that the outer shell of the present invention increases the residence time of the steam and product vapor by forcing them to flow through the insulating to the tank vents. Because of the longer residence time, these vapors will be hotter and will have absorbed more heat than would be the case if they could freely leave the insulation at any point on its surface.

In summary, the double wall structure of the present invention provides for a light weight storage tank having a porous insulation material which is designed to support the weight of the inner storage tank without any significant internal support structure. Furthermore, the tank of the present invention satisfies both UL 2085 and UL142 and UFC 79-4 requirements with respect to the 2-hour fire and secondary containment standards.

Although the description of the invention has included a description of a preferred embodiment and modifications and variations, other modifications and variations of the invention can also be used, the invention being defined by the appended claims.

We claim:

1. A tank assembly which includes an inner storage tank and a surrounding outer containment tank with said tanks defining a substantially uniform space therebetween, said space being filled with a cured light weight porous monolithic insulating material which comprises a mixture of cement, perlite and water having a porosity sufficient to allow liquid and vapors to migrate through said insulating material to a monitoring point, or points contained within said space and means for monitoring liquid and vapors located at said monitoring point or points, said insulating material shall freely permit vapors to migrate to an emergency vent port without over pressurization build-up within said space with said insulating material containing chemically bound water in amounts sufficient to keep the temperature of the inner storage tank at an acceptably low level during an external fire.

2. The assembly of claim 1 in which the porosity of the insulating material is in the range of about 40 to 80% by volume and its compressive strength is in the range of about 25 to 150 psi.

3. The assembly of claim 1 in which the monitoring means comprise a tube which operably connects the monitoring point to the outside of the tank assembly.

4. A tank assembly which includes an inner storage tank and a surrounding outer containment tank, with said storage and containment tanks defining a substantially uniform space therebetween, wherein the space between said tanks is filled with a cured light weight porous monolithic insulating material which comprises a mixture of cement, perlite and water, with the porosity of said insulating material being sufficient to allow for the flow of liquid or vapors through said insulating material and to be detected at a predetermined monitoring point within approximately 24 hours following liquid leakage from said inner storage tank with said insulating material containing chemically bound water in amounts sufficient to keep the temperature of the inner storage tank at an acceptably low level during an external fire.

5. The assembly of claim 4 in which the insulating material is formed from a slurry which comprises cement, perlite, an air entrainment agent and water.

6. The assembly of claim 5 in which the slurry further contains a plasticizer.

7. The assembly of claim 4 in which the cured insulating material has a compressive strength of at least 25 psi.

8. The assembly of claim 4 in which the cured insulating material has a compressive strength of about 25 to 150 psi, and where the porosity of said insulating is at least about 40% by volume.

9. The assembly of claim 4 which contains means for monitoring the leakage of liquid at said predetermined monitoring point.

10. The assembly of claim 9 which further contains means for venting fumes from said leakage liquid contained in the space containing said insulating material.

11. A tank assembly which includes an inner storage tank and a surrounding outer containment tank, with said storage and containment tanks defining a substantially uniform space therebetween, wherein the space between said tanks is filled with a cured light weight porous monolithic insulating material which comprises a mixture of cement, perlite and water, with the porosity of said insulating material being sufficient to allow for the flow of liquid and vapors through said insulating material and to be detected at a predetermined monitoring point within approximately 24 hours following liquid leakage from said storage tank, with said insulating material containing chemically bound water in amounts sufficient to keep the temperature of the inner storage tank at an acceptably low level during an external fire.

12. The assembly of claim 11 in which the insulating material is formed form a slurry which comprises cement, perlite, an air entrainment agent and water.

13. The assembly of claim 11 in which the insulating material has a compressive strength of 25 to 150 psi and a porosity of at least about 40% by volume.

14. A cylindrical steel tank assembly which includes an inner storage tank having a capacity of from abut 175 to 50,000 gallons and a surrounding outer containment tank, with said storage and containment tanks defining a substantially uniform space of about 2½ to 6 inches therebetween, wherein the space between said tanks is filled with a cured light weight porous monolithic insulating material which comprises a mixture of cement, perlite and water, with the porosity of said insulating material being sufficient to allow for the flow of liquid or vapors through said insulating material and to be detected at a predetermined monitoring point contained within said space approximately 24 hours following liquid leakage from said storage tank, with said insulating material containing chemically bound water in amounts sufficient to provide for added insulating protection to the inner storage tank during an external fire.

15. The tank assembly of claim 14 in which the tanks are rectangular in shape.

* * * * *